US005990799A

United States Patent [19]

Boon et al.

[11] Patent Number: 5,990,799

[45] Date of Patent: Nov. 23, 1999

[54] CHAIR OCCUPANCY MONITORING DEVICE

[76] Inventors: Stephen W. Boon, 616 Bush Hill Rd., Manchester, Conn. 06040; Keith P. Charles, 46 Old Farms West, Middletown, Conn. 06457

[21] Appl. No.: 09/166,990

[22] Filed: Oct. 6, 1998

[51] Int. Cl.[6] ..... G08B 21/00

[52] U.S. Cl. ..... 340/667; 340/666; 340/573.4; 200/85 R; 338/114

[58] Field of Search ..... 340/667, 665, 340/666, 686.1, 573.4; 200/85 R, 85 A, 511, 512, 513, 514, 515, 516, 517; 338/114, 118, 42

[56] References Cited

U.S. PATENT DOCUMENTS

| | | | |
|---|---|---|---|
| 3,704,352 | 11/1972 | Fontaine | 200/85 R |
| 3,879,586 | 4/1975 | DuRocher et al. . | |
| 3,952,173 | 4/1976 | Tsuji et al. . | |
| 3,960,044 | 6/1976 | Nagai et al. . | |
| 4,164,634 | 8/1979 | Gilano . | |
| 4,304,991 | 12/1981 | Weber . | |
| 4,308,439 | 12/1981 | Itoh . | |
| 4,317,012 | 2/1982 | Itoh . | |
| 4,390,758 | 6/1983 | Hendrickson . | |
| 4,401,896 | 8/1983 | Fowler et al. | 340/666 |
| 4,500,757 | 2/1985 | Rooney . | |
| 4,661,664 | 4/1987 | Miller | 200/86 R |
| 4,845,323 | 7/1989 | Beggs . | |
| 4,907,845 | 3/1990 | Wood . | |
| 5,796,059 | 8/1998 | Boon . | |
| 5,886,615 | 3/1999 | Burgess | 340/666 |

*Primary Examiner*—Daniel J. Wu
*Assistant Examiner*—Anh La
*Attorney, Agent, or Firm*—Alix, Yale & Ristas, LLP

[57] ABSTRACT

A chair occupancy monitoring device having pressure sensitive switch housed within a flexible cover. A cushion formed by a pair of foam pads positioned between the cover and the switch protects the switch and increases patient comfort. The switch includes first and second oppositely disposed base members. First and second electrical conductors are mounted to an interior portion of the first and second base members, respectively, on the surface facing the opposing base member. A gap is created between the electrical conductors by a pair of separator members which are disposed intermediate the oppositely disposed surfaces of the first and second base members and are mounted to a side portion of at least one of the base members. At least one electrically non-conductive contact limiter member is disposed intermediate the electrical conductors, covering a portion of the second electrical conductor. The separator members and contact limiter each have a compressibility defining a spring constant where the spring constant of the contact limiter is greater than the spring constant of the separator members. When the patients weight is applied to the device the separator member and the contact limiter member are compressed allowing the first electrical conductor to contact an uncovered portion of the second electrical conductor. When the patient's weight is removed the contact limiter and separator expand to break the contact and reopen the gap.

19 Claims, 6 Drawing Sheets

CHAIR OCCUPANCY MONITORING DEVICE

BACKGROUND OF THE INVENTION

The present invention relates to a pressure-sensitive switch apparatus and, more particularly, to such an apparatus for use in monitoring the presence of a patient in a wheel chair or other type of normal household seating.

A problem of considerable concern to health care providers is that of patients leaving a wheel chair when the patient is not safely ambulatory. The use of restraints to ensure the safety and well-being of such patients is becoming impracticable in many instances, not only because of legal issues relating to patient's rights, but also because of a change to a more considered approach by medical and nursing staff toward patients. Concerns regarding the use of restraints are even more acute in the case of home care where patients are typically cared for by family members.

There is a need, therefore, for a less invasive approach to monitor patients restricted to a wheel chair or other type of seating and to alert health care providers when patients attempts movement on their own.

SUMMARY OF THE INVENTION

Briefly stated, the invention is a preferred form is a chair occupancy monitoring device which has a pressure sensitive switch including upper and lower base members composed of a flexible, electrically non-conductive material. An upper electrically-conductive path is mounted to an interior portion of the lower surface of the upper base member and a lower conductive path is mounted to the interior portion of the upper surface of the lower base member. Electrically non-conductive separator members are disposed adjacent the perimeter portion the upper base member and the perimeter portion of the lower base member, separating the upper and lower conductive paths to form a gap. At least one electrically non-conductive contact limiter member is disposed intermediate the upper and lower conductive paths, providing at least one covered portion of the lower conductive path and at least one uncovered portion of the lower conductive path. The separator members and contact limiter each have a compressibility defining a spring constant where the spring constant for the contact limiter member is greater than the spring constant of the separator member. When a patient is present in the chair, the patient's weight provides sufficient pressure to compress the separator members and the contact limiter member such that the upper conductive path closes the gap to contact the uncovered portion of the lower conductive member and complete an electrical circuit. When the patient attempts to exit the chair, the resulting reduction of pressure allows the contact limiter and separator to expand. The contact limiter member biases the upper conductive path to break the contact between the upper and lower conductive paths and the side separators bias the upper base member to open the gap.

The opening of the circuit causes activation of an associated monitoring device, which may be a standard home security system, connected with the pressure-sensitive switch through associated electronic circuitry to alert the care giver that the patient is attempting movement on his or her own.

It is, therefore, an object of the invention to provide a simple and reliable electronic device which automatically alerts nursing staff or other care givers should a patient attempt to exit a wheel chair or other type of normal household seating unattended.

It is further object of the invention to provide such a device which can be utilized in combination with standard monitoring devices such as home security systems.

Other objects and advantages of the invention will become apparent from the drawings and specification.

BRIEF DESCRIPTION OF THE DRAWINGS

The present invention may be better understood and its numerous objects and advantages will become apparent to those skilled in the art by reference to the accompanying drawings in which.

DETAILED DESCRIPTION OF THE INVENTION

Figure 2:
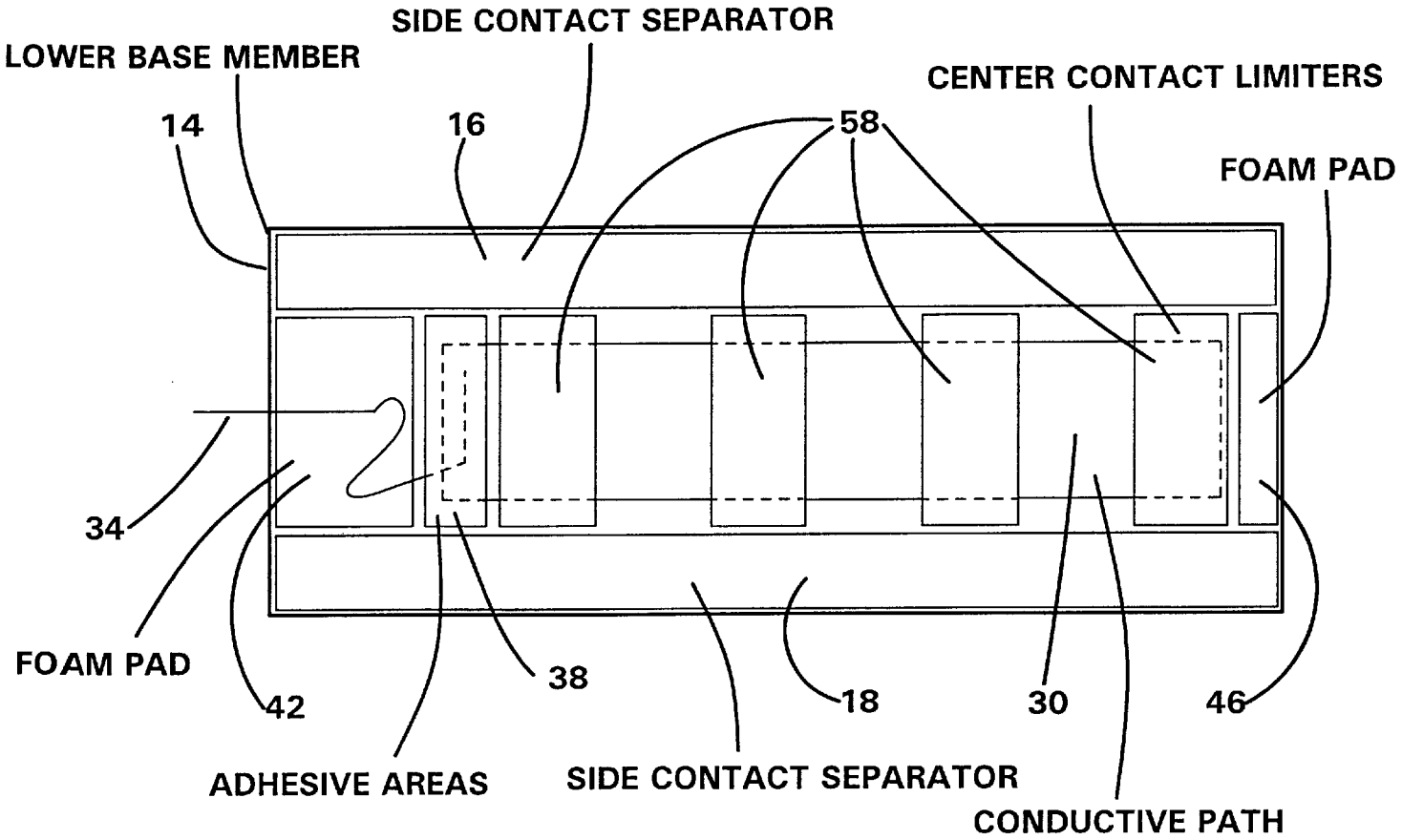
FIG. 2 is a cross-section view taken along line 2—2 of FIG. 4.
Figure 3:
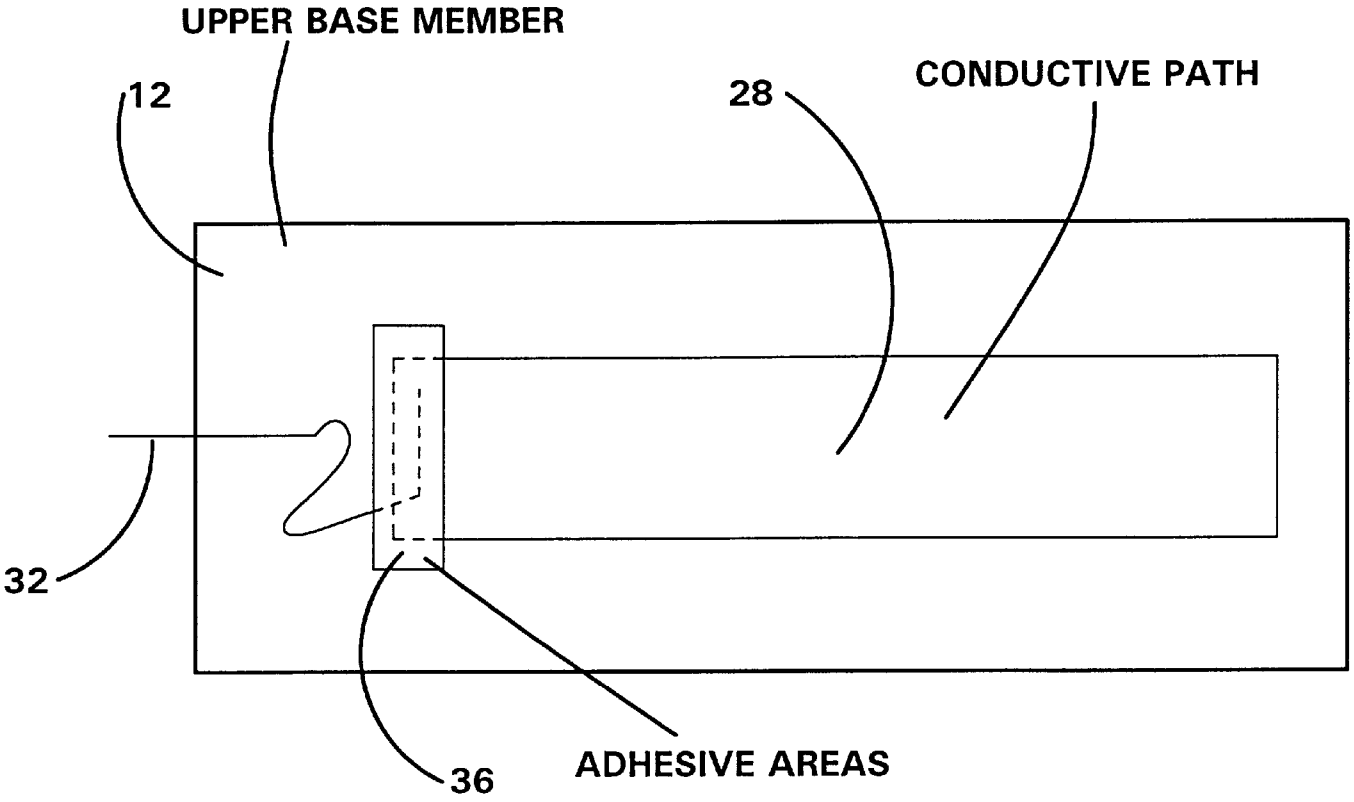
FIG. 3 is a cross-section view taken along line 3—3 of FIG. 4.
Figure 4:
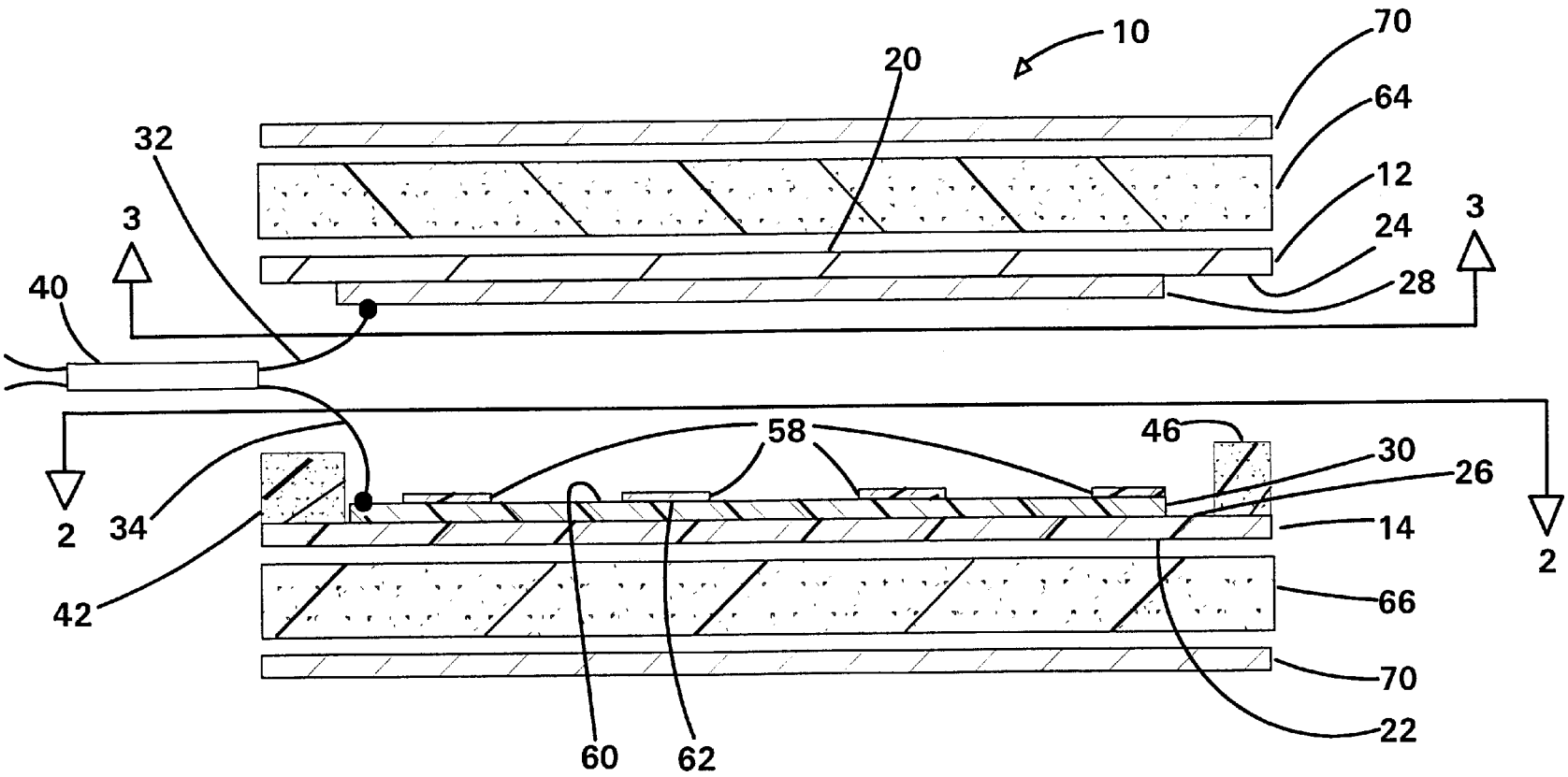
FIG. 4 is an exploded cross-section view taken along line 4—4 of FIG. 1.

With reference to the drawings wherein like numerals represent like parts throughout the several figures, a chair occupancy monitoring device in accordance with the present invention is generally designated by the numeral 8. With reference to FIGS. 2–4, the chair occupancy monitoring device 8 comprises a pressure-sensitive switch 10 which includes upper and lower base members 12, 14 which are formed from thin, non-conductive, flexible material. Preferably, this material is high-density polyethylene, although it should be understood that the invention is in no way limited in this regard and that a wide range of other non-conductive, flexible materials may be used. The base members 12, 14 are generally of rectangular configuration, and in the illustrated embodiment measure about 0.023 inches thick, 3.500 inches wide and about 8 inches long.

Each of the base members 12, 14 has, respectively, an outer surface 20, 22 and an inner surface 24, 26. A conductive path 28 is mounted on the inner surface 24 of base member 12, and conductive path 30 is mounted on the inner surface 26 of base member 14. While the conductive paths 28 and 30 may be hard wired in a conventional manner, in the preferred embodiment they are formed from a conductive, carbon graphite ink or paint which is silk-screened or otherwise uniformly applied to the inner surfaces 24, 26. The ink is combined with an acetate to enhance adhesion of the ink to the polyethylene, and with the ink in place, conductive value is maintained regardless of bending or twisting of the base members 12, 14.

Figure 1:
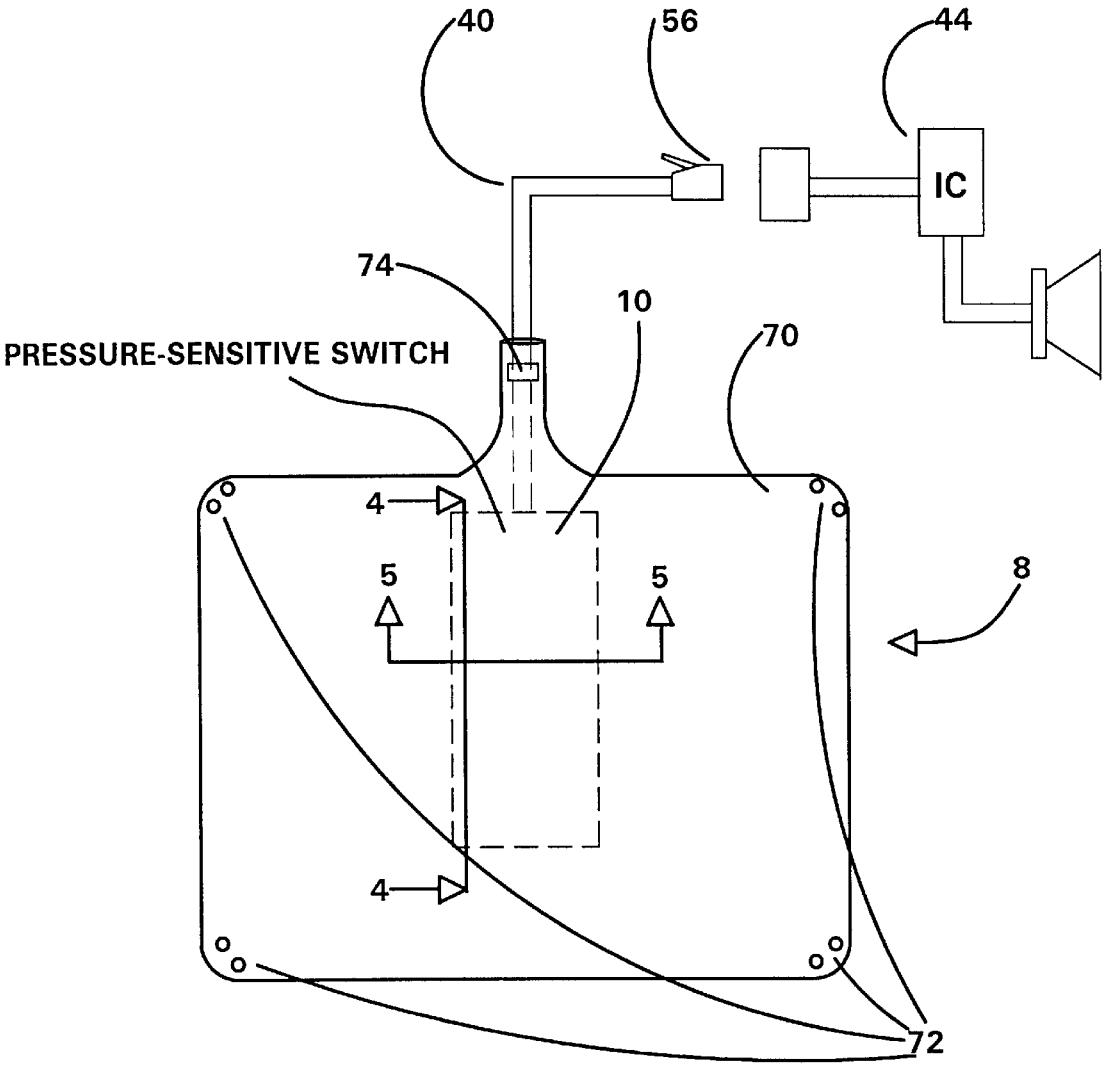
FIG. 1 is a top plan view, partly in phantom, of chair occupancy monitoring device in accordance with the invention which is installed in monitoring system.

In the illustrated embodiment, conductive paths 28 and 30 are about 0.001 to about 0.003 inches thick, about 1.500 inches wide and about 6 inches in length. The conductive paths are placed on the inner surfaces 24, 26 about 1.500 inches from the left end of the switch apparatus 10 as shown in FIGS. 1 and 2 and about 0.500 inches from the opposite end of the base members 12, 14.

Conductive wires 32, 34 are adhered to the conductive paths 28, 30, respectively, by adhesive areas 36, 38. The wires 32, 34 are insulated close to the conductive paths 28, 30 to prevent contact with other conductive components of the switch apparatus 10 and are jacketed to form a cable 40 to exit the switch apparatus. The cable 40 is adhered in place by a pad 42 of adhesive polyethylene foam mounted on inner surface 26. The foam pad 42 is adhesive on all sides and surrounds the exiting cable 40 to provide strain relief. In addition, the adhesive pad 42 provide bonding between base members 12 and 14. In the preferred embodiment of the invention, the foam pad 42 is 0.062 inches thick, about 1.250 inches wide and about 2.0 inches long. One more adhesive pad 46 is provided at the opposite end of the base member 14 to provide additional areas of bonding between the base members 12, 14. In the preferred embodiment, the pad 46 is about 0.062 thick and measure about 2 inches in width and about 0.500 inches in length.

Of course, other means for securing the wires 32, 34 to the conductive paths 28, 30 and for bonding the base members 12, 14 to one another could be substituted for the adhesive areas 36, 38 and the adhesive pads 42 and 46 without departing from the scope of the invention.

Figure 5:
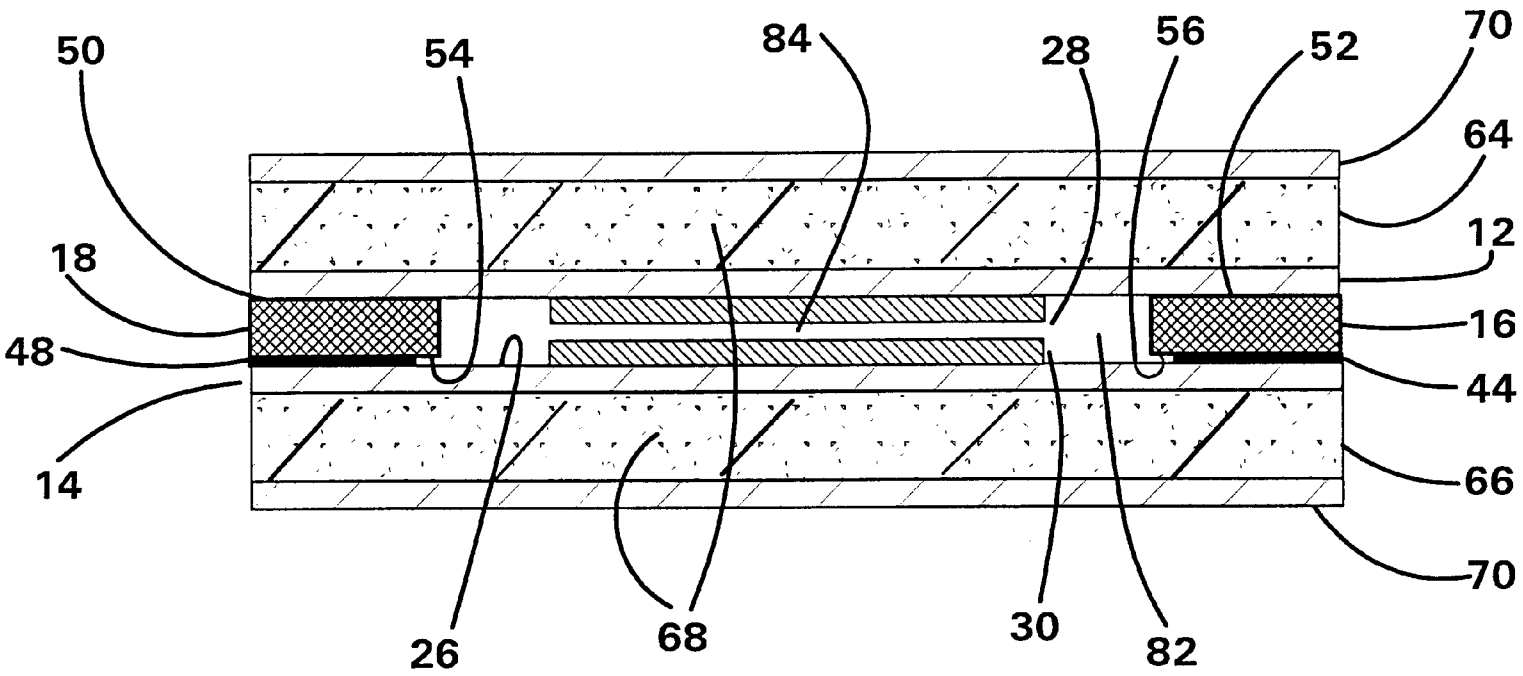
FIG. 5 is a cross-section view taken along line 5—5 of FIG. 1.
Figure 6:
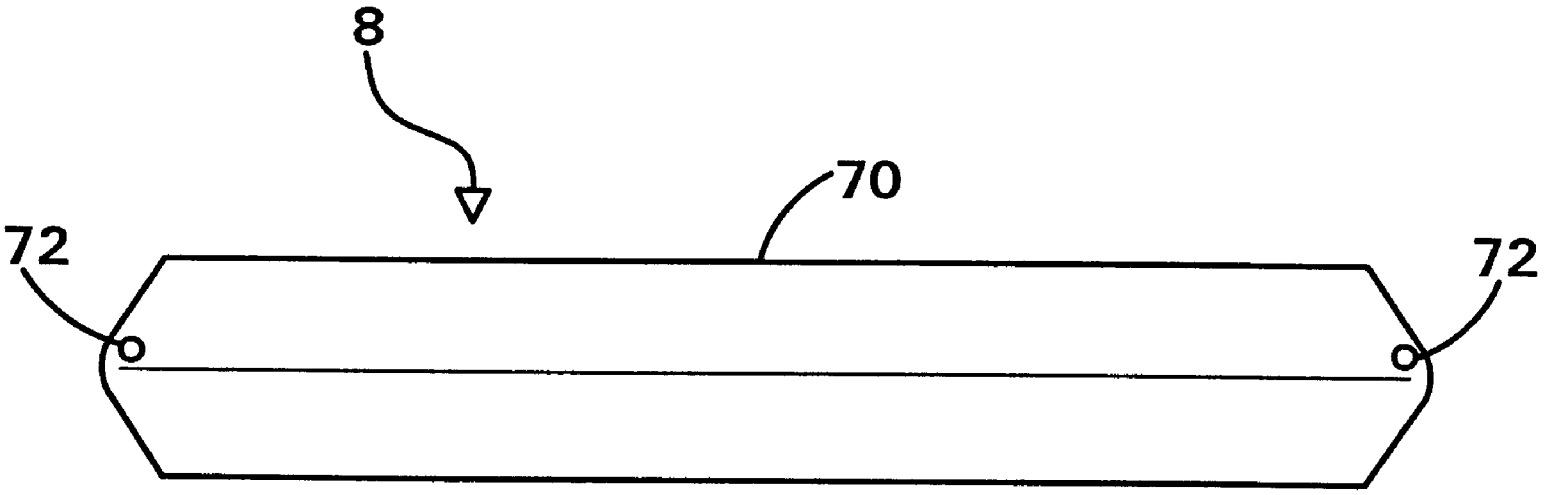
FIG. 6 is a side view of the chair occupancy monitoring device of FIG. 1.

As shown in FIGS. 4 and 5, the side contact separators 16, 18 are formed from thin, non-conductive flexible material. Preferably, this material is high-density polyethylene, although it should be understood that the invention is in no way limited in this regard and that a wide range of other non-conductive, flexible materials may be used. The side contact separators 16, 18 are generally of rectangular configuration, and in the illustrated embodiment measure about 0.030 inches thick, 0.750 inches wide and about 8 inches long. Each of the side contact separators 18, 16 has, respectively, an upper surface 50, 52 and a lower surface 54, 56. The side contact separators 16, 18 are attached to the inner surface 26 of base member 14, by thin adhesive pads 44, 48. The adhesive pads 44, 48 are adhesive on all sides and measure about 0.002 inches thick, 0.750 wide and about 8 inches long. The adhesive pads 44, 48 are applied to the lower surfaces 54, 56 of the side contact separators 18, 16 and are attached to the base member 14 inner surface 26.

The center contact limiters 58 are one-side adhesive pads about 0.015 inches thick, 0.750 inches wide and 2 inches long composed of cloth tape. Each of the center contact limiters 58 has respectively, an upper surface 60 and a lower surface 62. Preferably, the lower surface 62 is the adhesive side and the upper surface 60 has no adhesive. The center contact limiters 58 are attached to the conductive path 30 with the lower surface 62.

It should be appreciated that patients will sit on the chair occupancy monitoring device for extended periods of time. The forces imposed by such prolonged occupancy can have deleterious effects on the operation of the switch, resulting in a delay in actuation of the alarm when the patient exits the chair. The side contact separators 16, 18 and the center contact limiters 58 cooperate to minimize the effects of prolonged periods of application of weight to the device 8 and to minimize the time period for actuation of the alarm.

As shown in FIG. 5, the side contact separators 16, 18 define an air gap 82 between the upper and lower base members 12, 14 which has substantially the same dimensions as the thickness of the side contact separators 16, 18, 0.030 inches. The conductive paths 28, 30 each have a thickness of 0.001 to 0.003 inches, thereby defining a switch closure gap 84 having a width of 0.028 to 0.024 inches. The center contact limiters 58 are mounted within the switch closure gap 84 and have a thickness of 0.015 inches. When the patient sits on the device 10, the side contact separators are compressed, allowing the upper conductive path 28 to close the switch closure gap 84 until the upper conductive path 28 engages the center contact limiters 58. Continued pressure causes the center contact limiters 58 to be compressed, allowing the upper conductive path 28 to contact the lower conductive path 30 in the areas not covered by the center contact limiters 58 and thereby complete the circuit.

Utilizing both the side contact separators 16, 18 and the center contact limiters 58 as biasing members prevents inelastic deformation of either biasing member and ensures that the switch will open promptly. Further, the difference in thickness and the difference in materials between the center contact limiters 58 and the side contact separators 16, 18, results in the center contact limiters acting as a stiffer spring than the side contact separators 16, 18. Therefore, the center contact limiter 58 expands substantially immediately after the patient's weight is removed from the chair, forcing the upper conductive path 28 away from the lower conductive path 30, breaking the electrical contact. Expansion of the side contact separators 16, 18 fully opens the switch 10.

The switch apparatus 10 is entirely enclosed between two high density foam pads 64, 66 to form a cushion 68. The cushion 68 provides greater comfort for the patient, protects the switch 10, and keeps the switch 10 dry. Each foam pad 64, 66 is about 0.500 inches thick, 11 inches wide and 13 inches long. The switch 10 is attached to foam pad 64 with a standard foam spray adhesive and foam pad 66 is attached to foam pad 64 with a standard foam spray adhesive.

The foam cushion 68 is entirely enclosed in a vinyl covering 70, as shown in FIG. 1. The covering 70 is made from a thin, flexible medical grade polyvinyl chloride about 0.012 inches thick, 11.125 wide and 13.125 long. One end 80 is tapered to allow cable 40 enclosing conductive wires 32, 34 to exit the device 8. A cable clamp 74 secures the cable 40 to the tapered end 80 of the vinyl covering 70. A beading surrounds the covering 70 where each side has been wielded to form the covering.

The cover 70 is slightly larger in width and longer in length then the foam cushion 68 to accommodate breathing apertures 72 which are positioned in the space between the edges of the cushion 68 and the cover 70. Preferably, the breathing apertures 72 are about 0.100 inches in diameter and are located as pairs on all corners of the vinyl covering 70. The breathing apertures 72 allow air to return to the foam cushion 68 quickly when the patient removes their weight from the foam cushion 68.

As shown in FIG. 1, the cable 40 terminates with a connector 76 to facilitate hook-up and operation of an electronic control 78. The control 78 monitors the pressure applied and removed from the switch apparatus. With the chair occupancy monitoring device 8 in place on a wheelchair or other chair, the control 78 is able to monitor the patient beginning to exit the wheelchair or chair placing the patient in potential danger of injury.

In practice, the switch is designed to remain open absent the presence of the patient in the chair. When the patient is in a proper sitting position, the switch is closed. When the patient rises from the chair, base member 12 retracts from the contact limiters 58 and side contact separators 16 and 18, to cause an open condition and sound an alarm through the control 78.

It is further recognized, the switch apparatus may be placed on the back of a chair, to monitor a patient should they begin to fall forward, placing themselves in a medically compromising position. It is also recognized, that pressure sensitivity may be altered by simply changing the dimensions of the contact limiters 58 and side contact separators 16 and 18.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A chair occupancy monitoring device comprising a pressure sensitive switch for opening and closing an electrical monitoring circuit, wherein the switch includes:

upper and lower base members composed of a flexible, electrically non-conductive material, the upper base member having a lower surface having a perimeter portion and an interior portion, and the lower base member having an upper surface having a perimeter portion and an interior portion;

an upper conductive path mounted to the interior portion of the lower surface of the upper base member and a lower conductive path mounted to the interior portion of the upper surface of the lower base member, each of the conductive paths being composed of an electrically conductive material;

at least one separator member composed of electrically non-conductive material disposed adjacent the perimeter portion of the lower surface of the upper base member and the perimeter portion of the upper surface of the lower base member, the separator member defining a gap between the upper and lower conductive paths, the separator member having a compressibility defining a spring constant; and at least one contact limiter member composed of electrically non-conductive material disposed intermediate the upper conductive path and the lower conductive path, the contact limiter member defining a covered portion of the lower conductive path and an uncovered portion of the lower conductive path, the contact limiter member having a compressibility defining a spring constant which is greater than the spring constant of the separator member;

wherein the separator member and the contact limiter member are compressed when a weight force is applied to the device whereby the upper conductive path closes the gap to contact an uncovered portion of the lower conductive member and complete said electrical circuit, and wherein the contact limiter member and separator member expand when the weight force is removed whereby the contact limiter member biases the upper conductive path to break the contact between the upper and lower conductive paths and the separator member bias the upper base member to open the gap.

2. The chair occupancy monitoring device of claim 1 further comprising a cover having upper and lower sheets of flexible material joined along an edge to define a substantially enclosed cavity, the switch being disposed within the cavity.

3. The chair occupancy monitoring device of claim 2 further comprising a cushion including upper and lower foam pads disposed within the cavity, the upper foam pad being positioned intermediate the cover and the upper surface of the upper base member and the lower foam pad being positioned intermediate the cover and the lower surface of the lower base member.

4. The chair occupancy monitoring device of claim 3 wherein the switch and cushion each have a width and length, the width and length of the cushion being greater than the width and length of the switch.

5. The chair occupancy monitoring device of claim 4 wherein one of the upper or lower foam pads is attached to the switch and to the other of the upper or lower foam pads.

6. The chair occupancy monitoring device of claim 4 wherein one of the upper or lower foam pads is attached to the switch and to the other of the upper or lower foam pads by a foam spray adhesive.

7. The chair occupancy monitoring device of claim 3 wherein the cover defines at least one orifice for venting air.

8. The chair occupancy monitoring device of claim 7 wherein the cover and cushion each have a width and length, the width and length of the cover being greater than the width and length of the cushion to define a space between the cushion and the cover, the orifice being located in the space.

9. The chair occupancy monitoring device of claim 1 wherein the upper and lower base members each have oppositely disposed first and second sides and oppositely disposed first and second ends defining a substantially quadrilateral shape, and first and second separator members are mounted to the perimeter portion of the upper surface of the lower base member along the first and second sides of the lower base member, respectively.

10. The chair occupancy monitoring device of claim 9 wherein the switch further includes first and second foam pads, the first foam pad being mounted to the perimeter portion of the upper surface of the lower base member along the first end of the lower base member and to the perimeter portion of the lower surface of the upper base member along the first end of the upper base member and the second foam pad being mounted to the perimeter portion of the upper surface of the lower base member along the second end of the lower base member and to the perimeter portion of the lower surface of the upper base member along the second end of the upper base member.

11. The chair occupancy monitoring device of claim 10 wherein the switch further includes a cable having first and second electrically conductive wires connected to and in electrical communication with the upper and lower conductive paths, respectively, the cable extending longitudinally between the first foam pad and one of the upper or lower base members, the cable being mounted to the first foam pad whereby the first foam pad relieves strain on the connection between the first and second wires and the upper and lower conductive paths.

12. The chair occupancy monitoring device of claim 11 wherein the first and second foam pads are adhesive pads.

13. The chair occupancy monitoring device of claim 11 further comprising cable clamp and a cover having upper and lower sheets of flexible material joined along an edge to define a substantially enclosed cavity, the switch being disposed within the cavity and the cable clamp clamping the cable to the cover.

14. The chair occupancy monitoring device of claim 1 wherein the contact limiter member has a lower surface and the lower conductive path has an upper surface, the lower surface of the contact limiter member being mounted to the upper surface of the lower conductive path.

15. The chair occupancy monitoring device of claim 1 wherein the upper and lower conductive paths each are formed from an electrically conductive, carbon graphite ink or paint.

16. A chair occupancy monitoring device comprising:

a cover composed of a flexible material defining a substantially enclosed cavity;

a pressure sensitive switch disposed within the cavity including first and second base members having oppositely disposed surfaces, each of the base members having oppositely disposed first and second side portions, first and second electrical conductors mounted to the oppositely disposed surfaces of the first and second base members, respectively, intermediate the first and second side portions, first and second separator members disposed intermediate the oppositely disposed surfaces of the first and second base members, the first separator member being mounted to the first side portion of at least one of the first and second base members, the second separator member being mounted to the second side portion of at least one of the first and second base members, the separator members defining a gap between the first and second electrical conductors, the separator members each having a compressibility defining a first spring constant, and at least one electrically non-conductive contact limiter member disposed intermediate the first and second electrical conductors, the contact limiter member defining a covered portion of the second electrical conductor and an uncovered portion of the second electrical conductor, the contact limiter member having a compressibility defining a spring constant which is greater than the spring constant of the separator members; and a cushion including a first foam pad positioned intermediate the cover and the first base member and a second foam pad positioned intermediate the cover and the second base member.

17. The chair occupancy monitoring device of claim 16 wherein the first and second base members each further have oppositely disposed first and second end portions and the switch further includes first and second foam pads, the first foam pad being mounted to the first end portions of the first and second base members and the second foam pad being mounted to the second end portion of the first and second base members.

18. The chair occupancy monitoring device of claim 17 wherein the switch further includes a cable having first and second electrically conductive wires connected to and in electrical communication with the first and second electrical conductors, respectively, the cable extending longitudinally between the first foam pad and one of the first and second base members, the cable being mounted to the first foam pad whereby the first foam pad relieves strain on the connection between the first and second wires and the first and second electrical conductors.

19. The chair occupancy monitoring device of claim 16 wherein the first and second electrical conductors have oppositely disposed surfaces and the contact limiter member is mounted to the surface of one of the first and second electrical conductors.

* * * * *